United States Patent [19]

Dearwester

[11] Patent Number: 4,886,167

[45] Date of Patent: Dec. 12, 1989

[54] COMPACT, CORE-WOUND PAPER PRODUCT

[75] Inventor: Donald D. Dearwester, Hamilton, Ohio

[73] Assignee: The Procter & Gamble Company, Cincinnati, Ohio

[21] Appl. No.: 338,782

[22] Filed: Apr. 14, 1989

[51] Int. Cl.[4] ..... B65D 85/67

[52] U.S. Cl. ..... 206/389; 206/391; 206/394; 206/83.5

[58] Field of Search ..... 206/389, 391, 394, 83.5

[56] References Cited

U.S. PATENT DOCUMENTS

| | | | |
|---|---|---|---|
| Re. 12,257 | 8/1904 | Davis | 206/389 X |
| 425,033 | 4/1890 | Hicks | 206/389 |
| 745,612 | 12/1903 | Hoberg | 206/389 |
| 864,975 | 9/1907 | Luce | 206/417 |
| 1,316,041 | 9/1919 | Johnson | 206/389 |
| 3,537,226 | 11/1970 | Le Van et al. | 53/24 |
| 3,587,201 | 6/1971 | Strayer | 206/83.5 |
| 4,444,311 | 4/1984 | Rias | 206/391 |
| 4,595,093 | 6/1986 | Eckstein | 206/44 |

OTHER PUBLICATIONS

Photographs (3) taken of toilet tissue purchased Jun. 1989 at Hyundai Department Store, Seoul, Korea.

*Primary Examiner*—William Price

*Attorney, Agent, or Firm*—John M. Pollaro; Thomas J. Slone; Fredrick H. Braun

[57] ABSTRACT

A compact, low shipping volume paper product comprising a compression loaded, core-wound roll of paper and a compression constraining element; and concomitant method of making such a paper product. The roll comprises a length of paper which is wound on a tubular core, and which roll may have an obround or parallelopipedal shape due to being unidirectionally compressively loaded after winding; and then constrained against expanding by a suitable constraining element. Preferably, the roll is sufficiently compressively loaded to completely flatten the core. In another aspect of the invention, the roll may be further compressed by applying a compressive loading that is substantially greater than that needed to cause the core to become flat; and, some of that high compressive loading may be relieved before the constraining element is applied or secured. The paper product is susceptible to being reshaped by a consumer upon removal of the constraining element so that both the product and the core become somewhat round in cross section. Such a product may, for example, be a contemporary roll of toilet tissue or disposable paper towels on a contemporary paperboard core. The paper product may comprise a plurality of such rolls, and may be constrained by enclosures such as polyethylene film, and/or bands about individual rolls, and/or a band about an array of rolls.

13 Claims, 3 Drawing Sheets

COMPACT, CORE-WOUND PAPER PRODUCT

FIELD OF THE INVENTION

The invention pertains to roll-type paper products such as paper towels and toilet tissue which comprise lengths of a paper web which are wound onto disposable paper or cardboard cores; and which lengths of paper are conventionally subdivided into convenient sheets by transverse lines of perforations or slits. Such paper is generally high bulk by virtue of, for example, low density paper making methods, and/or by embossing. Thus, in addition to the void space within the conventional hollow cores, such papers have high void volumes. Accordingly, the present invention provides compact, core-wound paper products and methods of making such products having substantially reduced shipping and storage volumes.

BACKGROUND OF THE INVENTION

A Package Of Compressed Resilient Articles and Concomitant Method of Unpackaging is disclosed in U.S. Pat. No. 4,595,093 which issued June 17, 1986 to Joseph H. Eckstein. The figures depict the compressed articles as being cylindrical shaped and having circular tubular cores. The exemplary embodiment is stated to have been compressed to reduce the volume of the array of articles (e.g., rolls of toilet tissue) reduced by about twelve percent.

A Process of Packaging Batts of Fibers is disclosed in U.S. Pat. No. 3,537,226 which issued Nov. 3, 1970 to Martin D Le Van et al. This discloses forming a wound batt or roll on a rigid core; removing the core; encasing the roll in an air impervious bag; evacuating air; and securing the contracted structure with a wrapper of sufficient tensile strength to maintain substantially the contracted state. As shown in the figures, there is a void in the center of the completed package which has an oval cross section.

A Method Of Baling Fibrous Material and Bale is disclosed in U.S. Pat. No. 864,975 which issued Sept. 3, 1907 to Luce. This discloses flattening cylindrical bales of cotton which were formed on a mandrel, and removed from the mandrel before being flattened. Thus, they are coreless, annular bales. The apparatus includes means for tying the flattened bales together in pairs to provide duplex bales.

A Multi-Roll Package Of Compressible Materials is disclosed in U.S. Pat. No. 4,444,311 which issued Apr. 24, 1984 to Rias. This discloses a package which comprises compressible rolls, contoured panels having V-shape troughs, and bindings for securing the rolls and panels into a somewhat compressed orthogonal array. The invention is said to apply in particular to the packaging of fibrous insulating material such as insulating rolls which are subjected to limited compression in order to avoid permanent deformation.

SUMMARY OF THE INVENTION

In accordance with one aspect of the present invention, a paper product is provided which comprises a unidirectionally compression loaded, core-wound roll of paper and compression constraining means in which the roll of paper comprises a core and a length of paper wound thereon, and in which product the core is substantially flat and the product has a somewhat obround shape. The product is susceptible to being shaped by a user so that the product has a generally round cross section and so that the core has an open tubular shape. The constraining means may be a constraining band about the roll, or a constraining enclosure such as a wrapper of thermoplastic film or paper; or a combination of a band and an enclosure. Indeed, constraining means could even be a number of sewn stitches, or through-the-roll ties such as used on buttoned furniture cushions and mattresses. In another aspect of the invention, plural such rolls are disposed and constrained in a predetermined array. For example, a linear array of four rolls having their flattened cores in parallel relation. In such embodiments, the constraining means may comprise an array band, and/or an array enclosure, and may further comprise bands about the individual rolls of the array. In a method aspect of the invention, a core-wound paper product such as a roll of toilet tissue or a roll of paper towels is subjected to a unidirectional compressive loading of sufficient magnitude to cause the core to be substantially flattened; the constraining means are then secured while the roll is still compressively loaded; and then the compressive loading is relieved. In another method aspect of the invention, substantially more compressive loading is applied than required to flatten the core in order to achieve greater compaction prior to securing the constraining means; and, in yet another method aspect of the invention, such substantially more compressive loading is partially relieved prior to securing the constraining means. Preferably, such partial relieving is to the level at which the core of the product would commence to open if the loading were to be further relieved.

BRIEF DESCRIPTIONS OF THE FIGURES

While the specification concludes with claims which particularly point out and distinctly claim the subject matter regarded as forming the present invention, it is believed the invention will be better understood from the following description taken in conjunction with the accompanying drawings in which identical features in the several views are identically designated and in which:

DESCRIPTION OF THE INVENTION

Figure 1:
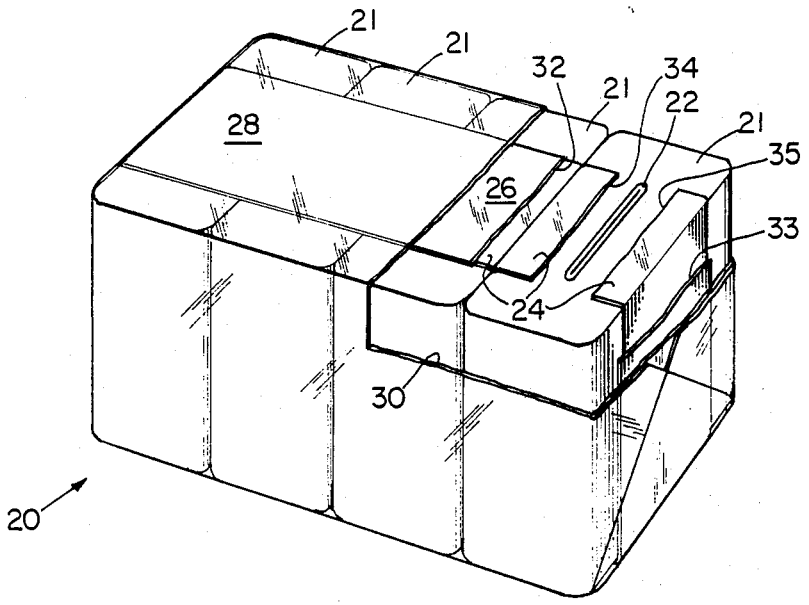
FIG. 1 is a perspective view of a paper product which embodies the present invention, and in which view some of the elements have been partially torn away to more clearly show the underlying elements.
Figure 2:
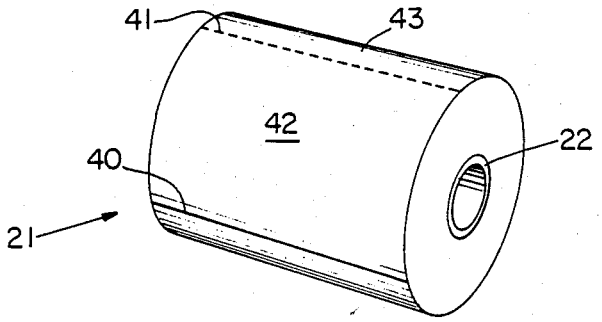
FIG. 2 is a perspective view of a core-wound, contemporary paper product such as a roll of toilet tissue paper having a cylindrical shape, and which includes a hollow tubular core having a circular cross section.

An exemplary embodiment of the present invention is shown in FIG. 1 to be a paper product 20 comprising a linear array of four flattened rolls 21 of paper, flattened cores 22 only one of which is visible in FIG. 1, a roll band 24 about each roll 21, an array band 26 about the array of four rolls 21, and a transparent enclosure 28 such as a wrapper or bag of sheet material. In order to clearly shown the various elements of paper product 20, a portion of enclosure 28 has been torn away leaving a torn edge 30; a portion of the array band 26 has been torn away leaving torn edges 32 and 33; and a portion of the band 24 about one roll 21 has been torn away leaving torn edges 34 and 35. An unflattened roll 21 of core-wound paper is shown in FIG. 2 to have a cylindrical shape, and a tubular core 22. The free edge of the first sheet 42 is designated free edge 40, and a line of perforations 41 is shown which demarks the first sheet 42 from the second sheet 43. Such lines of perforations are provided at sheet length intervals to facilitate tearing individual sheets from the roll.

Figure 3:
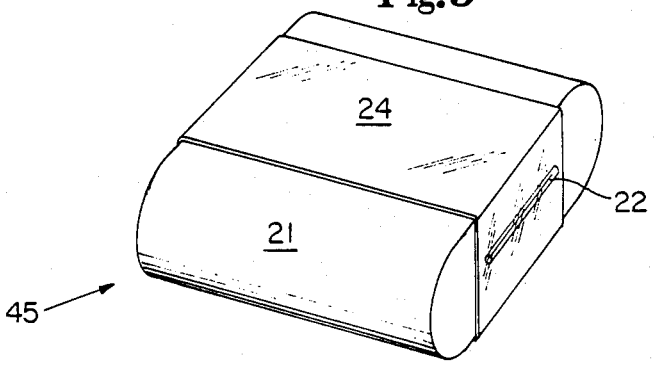
FIG. 3 is a perspective view of the article of FIG. 2 after it has been subjected to a sufficient unidirectional compressive force to flatten its core, and after a constraining band has been secured about the flattened roll in accordance with the present invention.

FIG. 3 illustrates a roll 21 of core-wound paper after it has been subjected to sufficient unilateral compressive loading to flatten core 22, and give roll 21 an obround shape; and after a constraining band 24 has been applied. The function of the constraining band 24 is to prevent substantial expansion of the roll 21 due to its inherent resilience until the constraining band 24 is removed as by a consumer. For convenience, the banded roll illustrated in FIG. 3 is designated banded roll product 45. Thus, while not wishing to clutter FIG. 1 with unnecessary designators, suffice it to say that paper product 20 as shown consists of four banded roll products 45.

Figure 4:
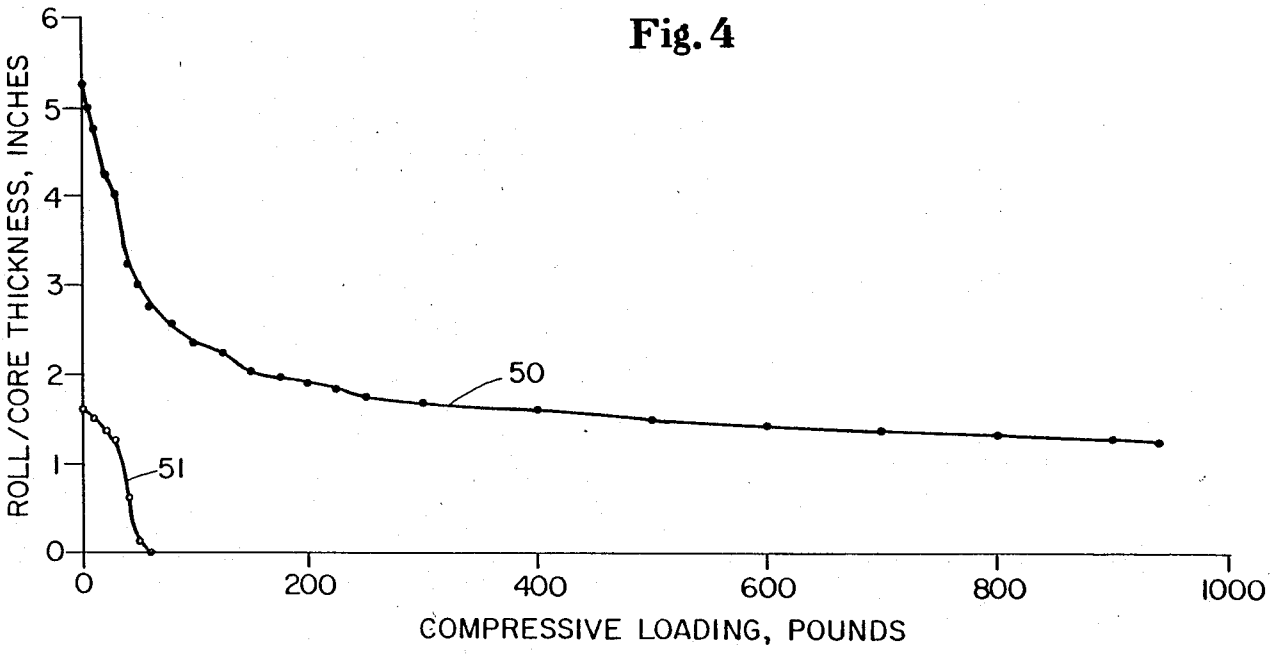
FIG. 4 is a graph which illustrates the reduction of the minor diametral dimensions of both the overall roll and the core as a roll of contemporary paper towels was subjected to a progressively increasing, unidirectional compressive loading.
Figure 5:
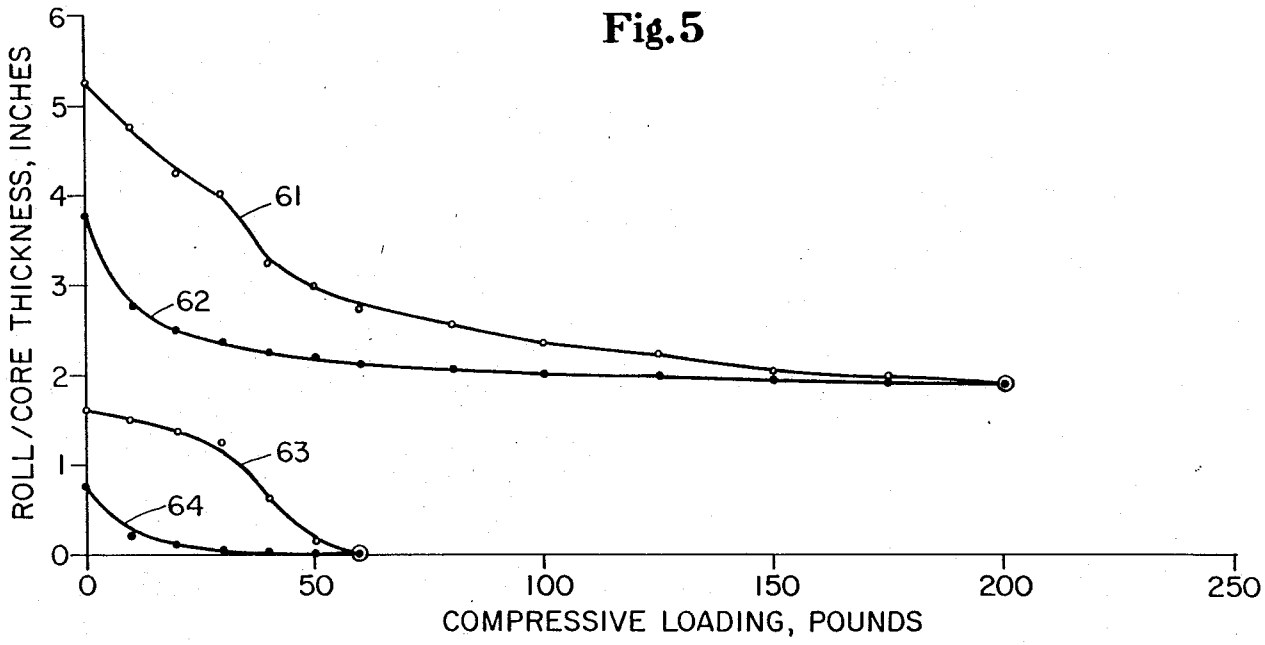
FIG. 5 is a graph which is similar to FIG. 5 except the roll of paper towels was subjected to a lesser maximum compressive loading; and curves are shown for both progressively increasing the loading, and progressively relieving the compressive loading. This illustrates the compressive hysteresis of such conventional paper towels.

An exemplary roll 21 of paper towels was used to obtain the test data which are embodied in the curves of FIGS. 4 and 5. The roll had a diameter of 5.25 inches (about 13.3 centimeters), and a length of 11 inches (about 28 centimeters). The core was a wound paper core having a diameter of about 1.625 inches (about 4.1 centimeters). The paper toweling had a basis weight of about 28 pounds per 3000 square feet (about 45.6 grams per square meter); and a density of about 0.09 grams per cc. The paper toweling consisted of two plies which had been embossed. While numerical data was obtained, and is discussed below and used to plot the curves in the graphs FIGS. 4 and 5, it is not intended to thereby limit the present invention to such numerical values or levels or ranges. Rather, the qualitative nature of the data are believed to be more significant with respect to understanding and practicing the present invention. Additionally, albeit the representative data were obtained through the use of a sample roll of paper towels having stated dimensions, weights and densities, and which paper was embossed, it is not intended to thereby limit the present invention to those values or characteristics.

The compressive loading referred to herein was obtained by placing a roll 21 of paper product on a flat, horizontal anvil plate with the axis of the cylindrical-shape roll extending horizontally. Strips of banding material were positioned under the roll and across the roll to enable banding the roll while it was still under compressive loading. A horizontal pressure plate was then pressure actuated downwardly to apply the compressive loading. During compressive loading, the roll was unconstrained horizontally. With this orientation, the distance between the anvil plate and the pressure plate is hereinafter referred to as the thickness of the roll 21; and it is alternatively referred to as the minor diametral dimension of the roll: that is, it is the diametral dimension of the roll which is reduced during compressive loading.

Referring now to FIG. 4, it is a graph on which curve 50 shows the relationship between the minor diametral dimension of a roll 21, FIG. 2, as it is subjected to a progressively increasing compressive loading; and curve 51 shows the concomitant relationship between the minor diametral dimension of core 22. These data were obtained using a roll of Bounty (registered trademark of The Procter & Gamble Company) paper towels. However, without wishing to thereby limit the present invention, it is believed that the character of the curves is more indicative of the benefits derived from the present invention than the absolute loadings and dimensions. For example, curve 51 indicates that the core has fully collapsed at a loading of about 60 pounds (about 27 kilograms); and that substantially more compaction was available upon increasing the loading on up to 940 pounds (about 427 kilograms).

FIG. 5 is a graph which illustrates the compressive hysteresis of both a roll 21 and a core 22, FIG. 2. Curve 61 is for roll 21 as compressive loading was increased, and curve 62 is for roll 21 as compressive loading was decreased. Similarly, curve 63 is for core 22 as compressive loading on the roll 21 increased; and curve 64 is for core 22 as compressive loading was progressively decreased. From these curves it is apparent that as compressive loading is increased up to about 200 pounds (about 91 kilograms), and then decreased to about 40 pounds (about 18 kilograms), the core remains substantially flat, and the final minor diametral dimension of roll 21 is about 2.25 inches (about 5.72 centimeters) whereas, when the progressive increase of compressive loading is stopped at 40 pounds (about 18 kilograms), the final minor diametral dimension of roll inches (about 8.26 centimeters). Thus, loading on up to 200 and then backing off or relieving to 40 pounds (about 18 kilograms) and then banding results in a banded thickness of banded roll product 45 of about 30.7 percent less than if simply loaded to 40 pounds (about 18 kilograms) and then banded. However, it is also clear o that simply loading a roll 21 up to about 40 pounds (about 18 kilograms) and then banding while holding that level of loading results in a reduction of its thickness of about 38 percent from the original thickness/diameter of roll 21.

From the foregoing, it is clear that substantial thickness reductions and concomitant volume reductions are available from simply compressively loading a roll 21 up to the level that causes the core to become substantially flat and banding the roll while it is so loaded; that further substantial thickness decreases and concomitant volume decreases are available thru applying higher levels of compressive loading and banding while the roll is loaded at the maximum applied loading; and that constraining forces can be substantially reduced without proportional increases in thickness and volume if the loading on the roll is relieved somewhat from its maximum value, for example, to the level at which the core would commence to open.

Alternative embodiments of the present invention, not illustrated in the figures, include embodiments similar to that shown in FIG. 1 except either the enclosure or the array band may be omitted, and the individual roll bands may be omitted. However, the most preferred embodiment at the present time comprises an enclosure of transparent polyethylene film, and individually banded rolls.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. A paper product comprising a unidirectionally compression loaded, core-wound roll of paper and compression constraining means, said roll of paper comprising a core and a length of paper wound thereon, said core being substantially flat and said product having a somewhat obround shape, said product being susceptible to being shaped by a user so that said product has a generally round cross section and so that said core has an open tubular shape.

2. The paper product of claim 1 wherein said core comprises resilient material, and is configured to have a right circular tubular shape when unconstrained.

3. The paper product of claim 1 wherein said core and said paper have sufficient resilience that, when unconstrained, said roll becomes more circular in cross section and said core opens up somewhat.

4. The paper product of claim 1, 2, or 3 wherein said means for constraining comprises a constraining band about said roll.

5. The paper product of claim 1, 2, or 3 wherein said means for constraining comprises a constraining enclosure.

6. The paper product of claim 1, 2, or 3 wherein said constraining means comprises a band about said roll and an enclosure.

7. A paper product comprising a plurality of unidirectionally compression loaded, core-wound rolls of paper and compression constraining means, said plurality of rolls being disposed in a predetermined array, and each roll of said rolls of paper comprising a core and a length of paper wound thereon, said core being substantially flat and said product having a somewhat obround shape, each said roll being susceptible to being shaped by a user so that said roll has a generally round cross section and so that said core has an open tubular shape.

8. The paper product of claim 7 wherein said compression constraining means comprises a constraining band about said array.

9. The paper product of claim 7 wherein said compression constraining means comprises a band about said array and a band about each of said rolls.

10. The paper product of claim 7 wherein said compression constraining means comprises a constraining enclosure of sheet material.

11. The paper product of claim 7 wherein said compression constraining means comprises an enclosure of sheet material and a band about each of said rolls.

12. The paper product of claim 7 wherein said compression constraining means comprises an enclosure of sheet material and a band about said array.

13. The paper product of claim 12 wherein said compression constraining means further comprises a band about each of said rolls.

* * * * *

UNITED STATES PATENT AND TRADEMARK OFFICE

CERTIFICATE OF CORRECTION

PATENT NO. : 4,886,167

DATED : December 12, 1989

INVENTOR(S) : Donald D. Dearwester

It is certified that error appears in the above-identified patent and that said Letters Patent is hereby corrected as shown below:

Column 2, line 62, "Fig. 5" (second occurrence) should read --Fig. 4--.

Column 3, line 10, reads "shown" should read --show--.

Column 4, line 38, after "roll" insert --21 is 3.25--.

Claims 2-6 and 8-13, "claim" should be --Claim--.

Signed and Sealed this

Nineteenth Day of November, 1991

*Attest:*

HARRY F. MANBECK, JR.

*Attesting Officer*

*Commissioner of Patents and Trademarks*

REEXAMINATION CERTIFICATE (1491st)

United States Patent [19]

Dearwester

[11] B1 4,886,167

[45] Certificate Issued Jun. 11, 1991

[54] COMPACT, CORE-WOUND PAPER PRODUCT

[75] Inventor: Donald D. Dearwester, Hamilton, Ohio

[73] Assignee: Procter & Gamble Company, Cincinnati, Ohio

Reexamination Request:
No. 90/002,086, Jul. 9, 1990

Reexamination Certificate for:

| | |
|---|---|
| Patent No.: | **4,886,167** |
| Issued: | **Dec. 12, 1989** |
| Appl. No.: | **338,782** |
| Filed: | **Apr. 14, 1989** |

[51] Int. Cl.[5] ..... B65D 85/67

[52] U.S. Cl. ..... 206/389; 206/391; 206/394; 206/83.5

[56] References Cited

U.S. PATENT DOCUMENTS

| | | | |
|---|---|---|---|
| 3,631,649 | 1/1972 | Close et al. | 53/3 |
| 4,602,472 | 7/1986 | Ampolini et al. | 53/438 |
| 4,679,379 | 7/1987 | Cassoli | 53/438 |
| 4,762,061 | 8/1988 | Watanabe et al. | 100/35 |
| 4,875,328 | 10/1989 | Meyer | 53/529 |
| 4,909,388 | 3/1990 | Watanabe | 206/410 |

FOREIGN PATENT DOCUMENTS 709363 5/1954 United Kingdom .

2173765A 10/1986 United Kingdom .

*Primary Examiner*—William I. Price

[57] ABSTRACT

A compact, low shipping volume paper product comprising a compression loaded, core-wound roll of paper and a compression constraining element; and concomitant method of making such a paper product. The roll comprises a length of paper which is wound on a tubular core, and which roll have an obround or parallelopipedal shape due to being unidirectionally compressively loaded after winding; and then constrained against expanding by a suitable constraining element. Preferably, the roll is sufficiently compressively loaded to completely flatten the core. In another aspect of the invention, the roll may be further compressed by applying a compressive loading that is substantially greater than that needed to cause the core to become flat; and, some of that high compressive loading may be relieved before the constraining element is applied or secured. The paper product is susceptible to being reshaped by a consumer upon removal of the constraining element so that both the product and the core become somewhat round in cross section. Such a product may, for example, be a contemporary roll of toilet tissue or disposable paper towels on a contemporary paperboard core. The paper product may comprise a plurality of such rolls, and may be constrained by enclosures such as polyethylene film, and/or bands about individual rolls, and/or a band about an array of rolls.

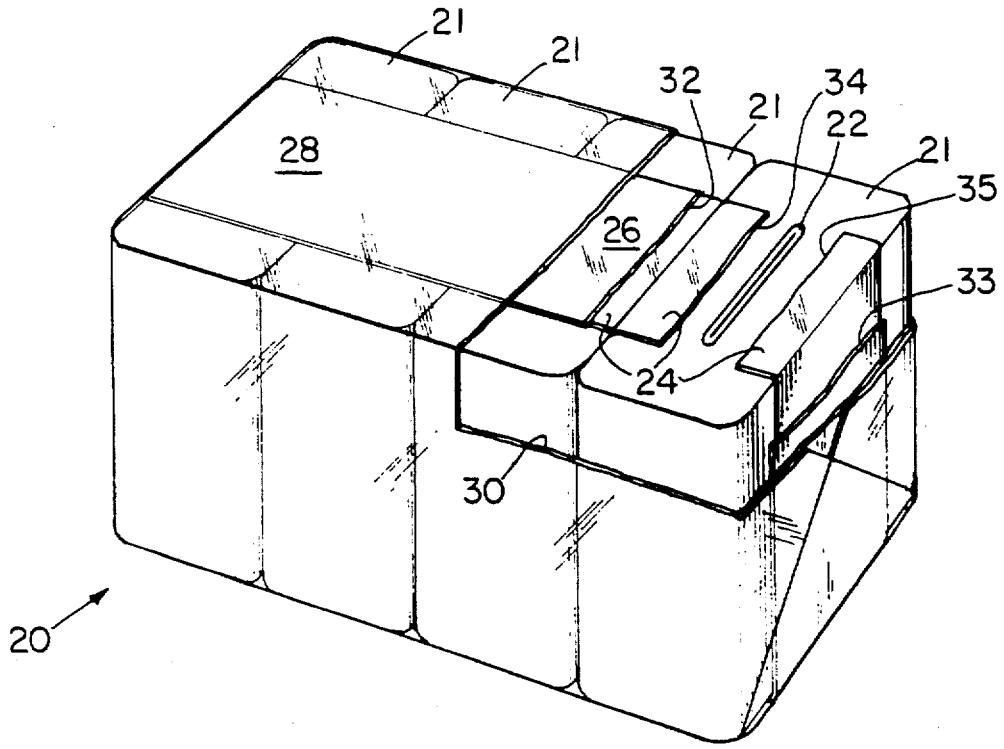

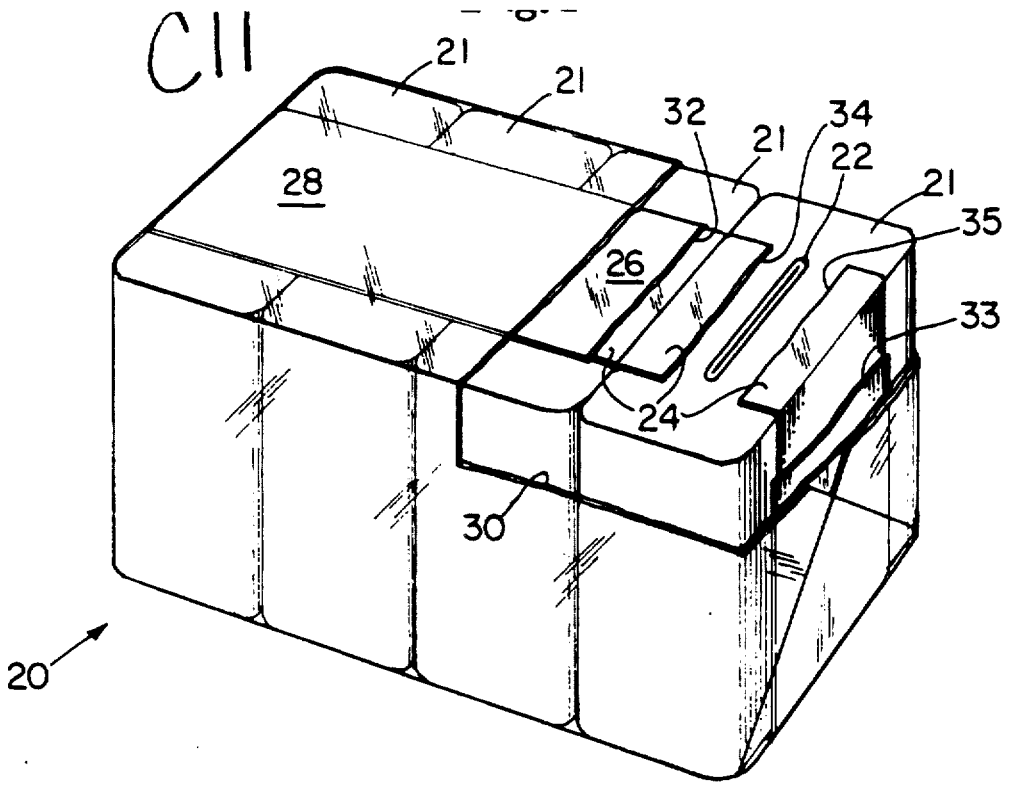
C11
21
21
32
34
21
22
21
35
28
26
33
24
30
20

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9 and 11–13 is confirmed.

Claims 1–8 and 10 are cancelled.

* * * * *